US010861405B2

(12) United States Patent
Thirumalai

(10) Patent No.: US 10,861,405 B2
(45) Date of Patent: Dec. 8, 2020

(54) COLOR TRANSFORM FOR RGBG SUBPIXEL FORMAT

(71) Applicant: Samsung Display Co., Ltd., Yongin (KR)

(72) Inventor: Vijayaraghavan Thirumalai, Fremont, CA (US)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/179,816

(22) Filed: Nov. 2, 2018

(65) Prior Publication Data

US 2020/0013327 A1 Jan. 9, 2020

Related U.S. Application Data

(60) Provisional application No. 62/695,578, filed on Jul. 9, 2018.

(51) Int. Cl.
*G09G 3/36* (2006.01)

(52) U.S. Cl.
CPC ..... *G09G 3/364* (2013.01); *G09G 2300/0452* (2013.01); *G09G 2340/06* (2013.01)

(58) Field of Classification Search
CPC .. G09G 2340/06; G09G 3/2003; G09G 3/364; G09G 2340/0457;
(Continued)

(56) References Cited

U.S. PATENT DOCUMENTS 7,155,055 B2 12/2006 Malvar
2005/0147295 A1 7/2005 Kim et al.
(Continued)

FOREIGN PATENT DOCUMENTS

CN 104867453 A 8/2015

OTHER PUBLICATIONS

Omar Benahmed Daho et al. "A JPEG-like algorithm for compression of single-sensor camera image," Proc. SPIE 7876, Digital Photography VII, 787610, Jan. 24, 2011, IS&T/SPIE Electronic Imaging, San Francisco Airport, CA, United States, pp. 1-13.
(Continued)

*Primary Examiner* — William A Beutel
(74) *Attorney, Agent, or Firm* — Innovation Counsel LLP

(57) ABSTRACT

A method for directly converting $Y_0Y_1CoCg$ or $Y_0Y_1C_bC_r$ image data to RGBG image data is presented, along with a display device that includes a decoder configured to perform such conversion. The conversions may be performed as follows:

$$\begin{pmatrix} R \\ G_0 \\ B \\ G_1 \end{pmatrix} = \frac{1}{\alpha} * \begin{pmatrix} \frac{1}{2} & \frac{1}{2} & 1 & -1 \\ \frac{3}{2} & -\frac{1}{2} & 0 & 1 \\ \frac{1}{2} & \frac{1}{2} & -1 & -1 \\ -\frac{1}{2} & \frac{3}{2} & 0 & 1 \end{pmatrix} \begin{pmatrix} Y_0 \\ Y_1 \\ Co \\ Cg \end{pmatrix} \text{ and}$$

$$\begin{pmatrix} R \\ G_0 \\ B \\ G_1 \end{pmatrix} = \frac{1}{\alpha} * \begin{pmatrix} \frac{1}{2} & \frac{1}{2} & -\frac{1}{4} & \frac{3}{4} \\ \frac{3}{2} & -\frac{1}{2} & -\frac{1}{4} & -\frac{1}{4} \\ \frac{1}{2} & \frac{1}{2} & \frac{3}{4} & -\frac{1}{4} \\ -\frac{1}{2} & \frac{3}{2} & -\frac{1}{4} & -\frac{1}{4} \end{pmatrix} \begin{pmatrix} Y_0 \\ Y_1 \\ Co \\ Cg \end{pmatrix}$$

Wherein $\alpha$ is a scaling factor.

21 Claims, 6 Drawing Sheets

(58) Field of Classification Search
CPC ..... G09G 2300/0452; G09G 3/3607; G09G 2340/02; H01L 27/3218; H01L 27/3213
See application file for complete search history.

(56) References Cited

U.S. PATENT DOCUMENTS

| | | | | |
|---|---|---|---|---|
| 2005/0259730 | A1 | 11/2005 | Sun | |
| 2006/0083432 | A1 | 4/2006 | Malvar | |
| 2009/0052772 | A1* | 2/2009 | Speirs | G09G 3/2092 382/166 |
| 2019/0296096 | A1* | 9/2019 | Tian | G09G 3/3225 |

OTHER PUBLICATIONS

Zied Kricha et al., "A Comparison Between Different Color Spaces for Watermarking Purpose," 17th international conference on Science and Techniques of Automatic control & computer engineering—STA'2016, Sousse, Tunisia, Dec. 19-21, 2016, pp. 1-8.
European Search Report, Application No. 19185329.0, dated Nov. 27, 2019, pp. 1-12.
Displays, Chapter 3, pp. 9-16.
Henrique S. Malvar, "Lifiting-based reversible color transformations for image compression", Applications of Digital Image Processing XXI, 2008, 10 pages, col. 7073.
Peggy Molaney, "Exhibit C: IPR Response Form", Microsoft Corporation, pp. 14-16, VESA Policy # 200B.

* cited by examiner

COLOR TRANSFORM FOR RGBG SUBPIXEL FORMAT

CROSS-REFERENCE TO RELATED APPLICATION(S)

This application claims the benefit of U.S. Provisional Patent Application No. 62/695,578 filed on Jul. 9, 2018, the content of which is incorporated by reference herein.

BACKGROUND

The inventive concept disclosed herein relates to a method and apparatus for achieving color transform in RGBG format.

Display devices such as liquid crystal displays (LCDs) and organic light-emitting diode displays (OLEDs) have various applications and come in a wide range of sizes. Most of the display devices incorporate pixels for displaying images, wherein a typical pixel includes a red (R) sub-pixel unit, a green (G) sub-pixel unit, and a blue (B) sub-pixel unit. The sub-pixels may be arranged in a number of different ways. One common layout is the RGB layout that includes the same number of R, G, and B sub-pixels repeating themselves in a systematic way, as shown in FIG. 1. Another layout, which is sometimes referred to as the "Pentile RGBG," is the RGBG layout that includes twice as many G sub-pixels than R sub-pixels or B sub-pixels, shown in FIG. 2. As the human visual system is more sensitive to green than to red or blue, the RGBG layout is sometimes preferred.

In the RGB layout, six sub-pixels (RGBRGB) are used for two pixels of information, as shown in FIG. 3A. In contrast, in the RGBG layout, only four sub-pixels (RGBG) are used for two pixels of information (see FIG. 3B). As the RGBG layout requires ⅓ fewer pixels than RGB layout to display the same image, RGBG may have the advantage of improved power efficiency over the traditional RGB configuration.

There are different ways to lay out the sub-pixels even in the RGBG category. For example, as illustrated in FIG. 4A and FIG. 4B, the red and blue sub-pixels may be interleaved in the vertical direction or not interleaved in the vertical direction.

A display device receives source image data for R, G, and B. The source image data indicates the image that is to be rendered on a display panel. A sub-pixel rendering unit, which is part of the display device, renders the image indicated by the source image data onto the display panel. The rendering process often includes color transform or color space conversion, which refers to the transformation of an image from one color space to another color space. During color transform, color components (R, G, and B) are correlated between the image data and the sub-pixel layout of the particular device, for example for efficient compression.

For an RGB layout, popular color transforms include YCbCr and YCoCg, wherein Y=luma, Cb=chroma blue, Cr=chroma red, Co=chroma orange, and Cg=chroma green.

YCoCg color transform, shown below, is generally computationally simpler than YCbCr transform (YCbCr requires floating point calculation):

$$\begin{pmatrix} Y \\ Cg \\ Co \end{pmatrix} = \begin{pmatrix} \frac{1}{4} & \frac{1}{2} & \frac{1}{4} \\ -\frac{1}{4} & \frac{1}{2} & -\frac{1}{4} \\ \frac{1}{2} & 0 & -\frac{1}{2} \end{pmatrix} \begin{pmatrix} R \\ G \\ B \end{pmatrix}$$

Forward transform $$\begin{pmatrix} R \\ G \\ B \end{pmatrix} = \begin{pmatrix} 1 & -1 & 1 \\ 1 & 1 & 0 \\ 1 & -1 & -1 \end{pmatrix} \begin{pmatrix} Y \\ Cg \\ Co \end{pmatrix}$$

Inverse transform

Most known color transforms are applicable to the RGB format. Since RGBG format has advantages as described above, it is desirable to generate a color transform method that is applicable to the RGBG format.

SUMMARY

In one aspect, the inventive concept pertains to a method of displaying an RGBG-formatted image data. The method entails receiving input image data in $Y_0Y_1CoCg$ format, and decoding the received input image data by applying the inverse-color transform as follows: determining an R value using $Y_0$, $Y_1$, Co, and Cg; determining a $G_0$ value using $Y_0$, $Y_1$, and no more than one of Cg and Co; determining a B value using $Y_0$, $Y_1$, Co, and Cg; and determining a $G_1$ value using $Y_0$, $Y_1$, and no more than one of Cg and Co.

In another aspect, the inventive concept pertains to a method for color transform of an RGBG-formatted image data. The method involves determining a first luma value based on R, B, and one of $G_0$ or $G_1$, determining a second luma value based on R, B, and the other one of $G_0$ or $G_1$, determining a first chroma value, and determining a second chroma value.

In another aspect, the inventive concept pertains to a display device configured to perform the above methods.

DETAILED DESCRIPTION

A method for a color transform applicable to RGBG format is presented. More specifically, a double-luma $Y_0Y_1CoCg$ color transform and $Y_0Y_1CbCr$ for RGBG format is presented. The inventive concept encompasses a direct transform applicable to RGBG, which is distinguishable from a two-step transform that involves first converting RGBG to an intermediate format such as RGB format and then applying a color transform such as YCoCg or YCbCr. In a two-step transform approach, RGBG to RGB conversion may be executed by setting unknown sub-pixels to zero or calculating based on interpolation. Conversion from RGBG to RGB increases the number of pixels by ⅓, and adversely impacts compression efficiency as there are more pixels to compress in RGB than in RGBG. The two-step transform approach also involves unnecessary computation that may be costly, and has latency or delay due to the intermediate RGBG to RGB format conversion. The direct color transform for RGBG that is disclosed herein overcomes these disadvantages associated with the two-step transform approach, thereby fundamentally changing the RGBG color transform process and dramatically improving the efficiency of the color transform. Furthermore, the direct color transform for RGBG that is disclosed herein is applicable to different formats/layouts of RGBG as long as a basic unit can be formed.

The technique disclosed herein does not require an intermediate RGBG to RGB conversion. The direct $Y_0Y_1CoCg$ color transform that is disclosed herein is easier to implement than the conventional transform because there are no floating-point calculations. As there are no division operations, the transform technique disclosed herein is hardware friendly.

Figure 2:
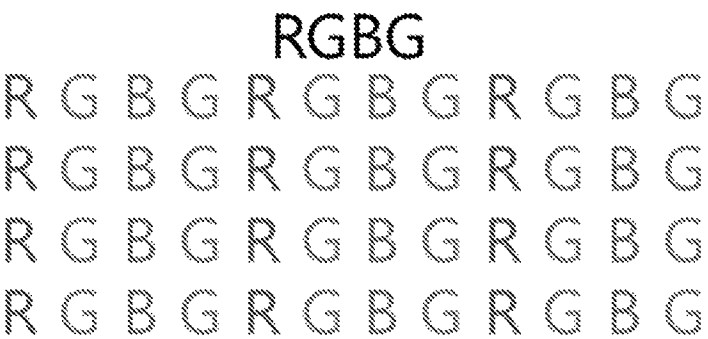
FIG. 2 Prior Art
FIG. 2 depicts a conventional RGBG layout that includes twice as many G sub-pixels than R sub-pixels or B sub-pixels.
Figure 1:
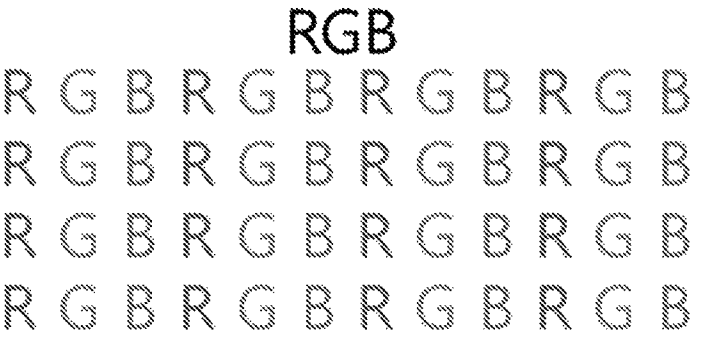
FIG. 1 Prior Art
FIG. 1 depicts a conventional RGB layout that includes the same number of R, G, and B sub-pixels.
Figure 3B:
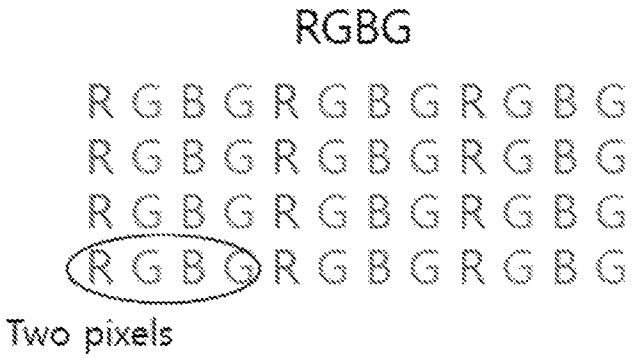
FIG. 3B Prior Art
FIG. 3B depicts two pixels in a conventional RGBG layout.
Figure 3A:
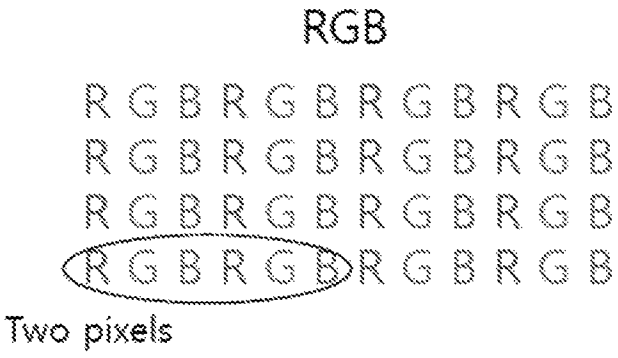
FIG. 3A Prior Art
FIG. 3A depicts two pixels in a conventional RGB layout.
Figure 4A:
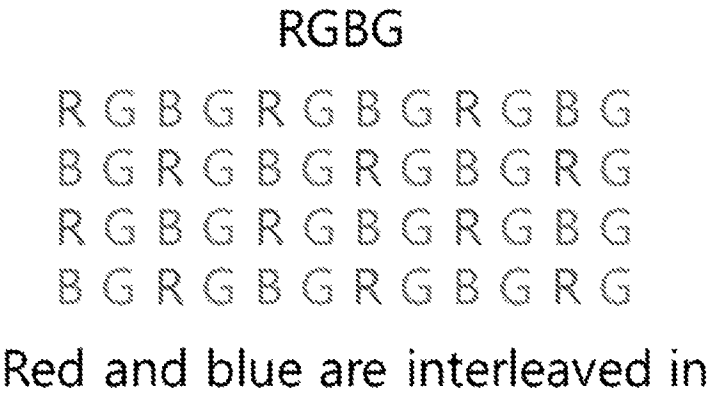
FIG. 4A Prior Art
FIG. 4A and FIG. 4B depict different configurations for RGBG layouts.
Figure 4B:
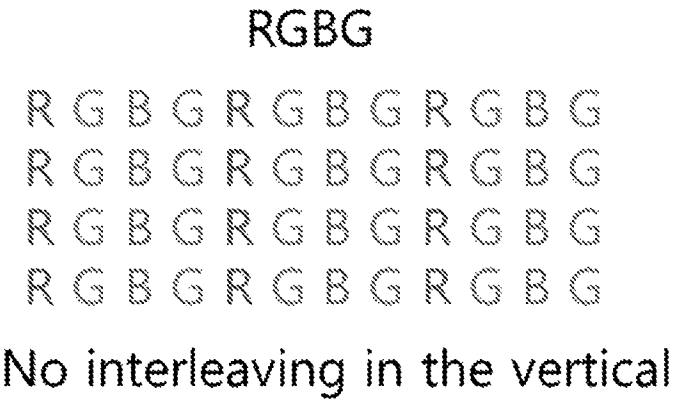
FIG. 4B Prior Art
Figure 5:
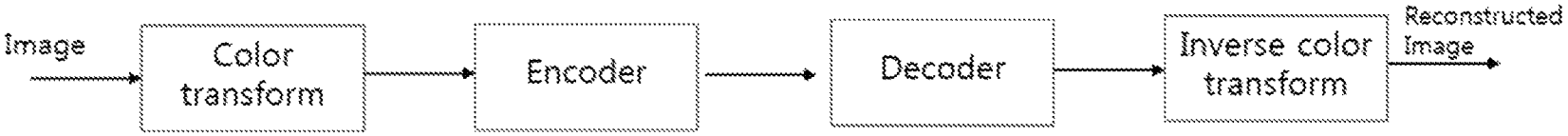
FIG. 5 depicts an example of a compression scheme with a color transform.

FIG. 5 depicts an example of a compression scheme with a color transform that may be executed by a display driver. As used herein, "color transform" or "color space conversion" refers to the transformation of an image from one color space to another. In the disclosure, color transform is described in the context of RGBG→$Y_0Y_1CoCg$ conversion or RGBG→$Y_0Y_1CbCr$ conversion as examples. In a format such as RGB or RGBG, there is a correlation between the channels R, G, and B such that there is interdependence between channels. The color transform on RGBG is applied prior to compression because compressing the RGBG itself is not optimal due to the existing correlation, and furthermore to prevent any complication of decoding process resulting from application of predictive coding where one component is predicted from another. The color transform process de-correlates the dependencies that exist between R, G, and B channels. After taking color transform, compression may be applied independently for each channel, which might simplify the decoding process.

In one embodiment, the Decoder and the Inverse color transform blocks are incorporated into a display device, which receives a color-transformed encoded input image data. The input image data may be large. If the display device is high-resolution and it is combined with high bit depth (e.g., a 4K or 8K display panel combined with bit depth of 10 or 12 bits per component), the image data would have to be fed at a high bit-rate that may be difficult to achieve due to bandwidth limitations. In such cases, compression of the data facilitates the data feed to happen at a reduced rate that further translates into minimum power consumption. The display driver configuration that is suitable for implementing the inventive concept is well known.

The color transform is performed before compression such that each component in $Y_0Y_1CoCg$, $Y_0Y_1CbCr$, YCoCg, or YCbCr is compressed independently. In the example shown in FIG. 5, color transform is performed on the RGBG input image such that the correlated components (e.g., R, G, and B) are mapped onto another space for efficient compression (via Color Transform). The color-transformed data is subjected to compression and encoded. The compressed representation of the input image data reaches a display device, and the decoding is typically performed at or near the display device that receives the encoded data. The decoded data is then inverse-color transformed back to RGBG/RGB format to generate a reconstructed image for the display device.

For an RGB layout, popular color transforms include YCbCr and YCoCg, wherein Y=luma, Cb=chroma blue, Cr=chroma red, Co=chroma orange, and Cg=chroma green.

YCoCg color transform, shown below, is generally computationally simpler than YCbCr transform:

$$\begin{pmatrix} Y \\ Cg \\ Co \end{pmatrix} = \begin{pmatrix} \frac{1}{4} & \frac{1}{2} & \frac{1}{4} \\ -\frac{1}{4} & \frac{1}{2} & -\frac{1}{4} \\ \frac{1}{2} & 0 & -\frac{1}{2} \end{pmatrix} \begin{pmatrix} R \\ G \\ B \end{pmatrix}$$

Forward transform $$\begin{pmatrix} R \\ G \\ B \end{pmatrix} = \begin{pmatrix} 1 & -1 & 1 \\ 1 & 1 & 0 \\ 1 & -1 & -1 \end{pmatrix} \begin{pmatrix} Y \\ Cg \\ Co \end{pmatrix}$$

Inverse transform

Figure 6:
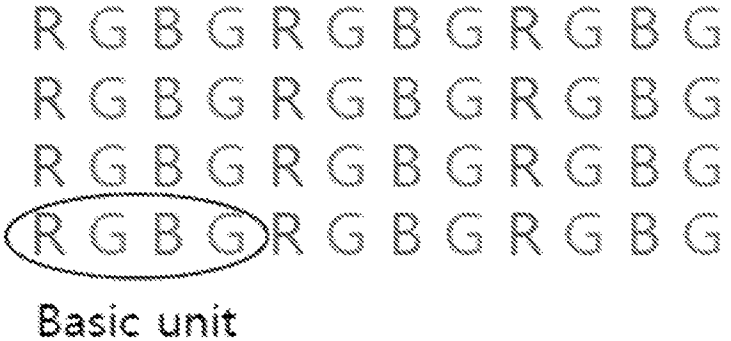
FIG. 6 depicts an example of a basic unit in an RGBG format.

In accordance with the inventive concept, a $Y_0Y_1CoCg$ color transform is proposed to be applied directly to each basic unit of the RGBG format, i.e. without a conversion to the RGB format. The $Y_0Y_1CoCg$ color transform is applied to each basic unit. A basic unit for an RGBG format contains two G, one R, and one B sub-pixels. FIG. 6 depicts an example of a basic unit in an RGBG format. Two Y luma values are calculated as there are two green sub-pixels in one basic unit.

The forward transform for RGBG is as follows:

$$\begin{pmatrix} Y_0 \\ Y_1 \\ Co \\ Cg \end{pmatrix} = \alpha * \begin{pmatrix} \frac{1}{4} & \frac{1}{2} & \frac{1}{4} & 0 \\ \frac{1}{4} & 0 & \frac{1}{4} & \frac{1}{2} \\ \frac{1}{2} & 0 & -\frac{1}{2} & 0 \\ -\frac{1}{4} & \frac{1}{4} & -\frac{1}{4} & \frac{1}{4} \end{pmatrix} \begin{pmatrix} R \\ G_0 \\ B \\ G_1 \end{pmatrix}$$

wherein $\alpha$ is a scaling factor or a constant, such as 1 or 2. As shown above, the first luma value $Y_0$ is dependent on R, $G_0$, and B sub-pixels. The second luma value $Y_1$ is dependent on R, B, and $G_1$. Chroma orange Co depends on R and B, and chroma green Cg depends on R, $G_0$, B, and $G_1$.

The color transform may be mathematically lossless to avoid artifacts introduced in the reconstructed image due to color transformation. This is a lossless process, and the inverse transform is as follows:

$$\begin{pmatrix} R \\ G_0 \\ B \\ G_1 \end{pmatrix} = \frac{1}{\alpha} * \begin{pmatrix} \frac{1}{2} & \frac{1}{2} & 1 & -1 \\ \frac{3}{2} & -\frac{1}{2} & 0 & 1 \\ \frac{1}{2} & \frac{1}{2} & -1 & -1 \\ -\frac{1}{2} & \frac{3}{2} & 0 & 1 \end{pmatrix} \begin{pmatrix} Y_0 \\ Y_1 \\ Co \\ Cg \end{pmatrix}$$

Figure 7B:
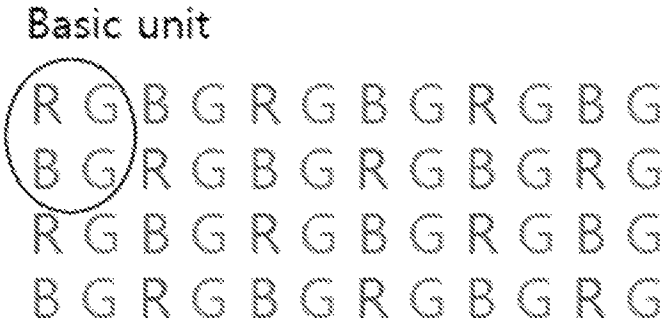
FIGS. 7A and 7B depict other examples of RGBG format to which the above color transform may be applied.
Figure 7A:
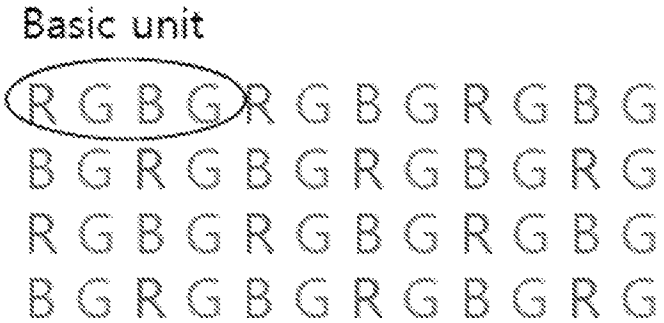

FIGS. 7A and 7B depict other examples of RGBG format to which the above color transform may be applied. As shown above, the image data (RGB in this example, but could be in RGBG or any other color space) is subjected to the color transform before getting encoded (e.g., compressed). After the decoding (e.g., de-compression) is done, the inverse color transform is applied to obtain the reconstructed image.

The double-luma $Y_0Y_1CoCg$ color transform in accordance with the inventive concept distinguishes itself from YCoCg compression. For compressing YCoCg data, the general practice is to put more compression effort into chroma (Co, Cg) than to luma (Y), as the human vision is more sensitive to the luma than chroma On a similar note, for compressing the $Y_0Y_1CoCg$ data, more focus may be put on the two luma channels than on the chroma channels (Co, Cg).

The techniques disclosed herein may be applied to any Reversible Color Transform (RCT), such as $Y_0Y_1CbCr$ transform. The forward transform for $Y_0Y_1CbCr$ is as follows:

$$\begin{pmatrix} Y_0 \\ Y_1 \\ Cb \\ Cr \end{pmatrix} = \alpha * \begin{pmatrix} \frac{1}{4} & \frac{1}{2} & \frac{1}{4} & 0 \\ \frac{1}{4} & 0 & \frac{1}{4} & \frac{1}{2} \\ 0 & -\frac{1}{2} & 1 & -\frac{1}{2} \\ 1 & -\frac{1}{2} & 0 & -\frac{1}{2} \end{pmatrix} \begin{pmatrix} R \\ G_0 \\ B \\ G_1 \end{pmatrix}$$

wherein $\alpha$ is a constant.

As this is a lossless process, the inverse transform is as follows:

$$\begin{pmatrix} R \\ G_0 \\ B \\ G_1 \end{pmatrix} = \frac{1}{\alpha} * \begin{pmatrix} \frac{1}{2} & \frac{1}{2} & -\frac{1}{4} & \frac{3}{4} \\ \frac{3}{2} & -\frac{1}{2} & -\frac{1}{4} & -\frac{1}{4} \\ \frac{1}{2} & \frac{1}{2} & \frac{3}{4} & -\frac{1}{4} \\ -\frac{1}{2} & \frac{3}{2} & -\frac{1}{4} & -\frac{1}{4} \end{pmatrix} \begin{pmatrix} Y_0 \\ Y_1 \\ Cb \\ Cr \end{pmatrix}$$

In the $Y_0Y_1CbCr$ transform, $Y_0$ depends on R, $G_0$, and B and Y1 depends on R, B, and $G_1$, similarly to the $Y_0Y_1CoCg$ transform shown above. Cb depends on $G_0$, B, and $G_1$ but not on R, and Cr depends on R, $G_0$, and $G_1$ but not on B.

Figure 8:
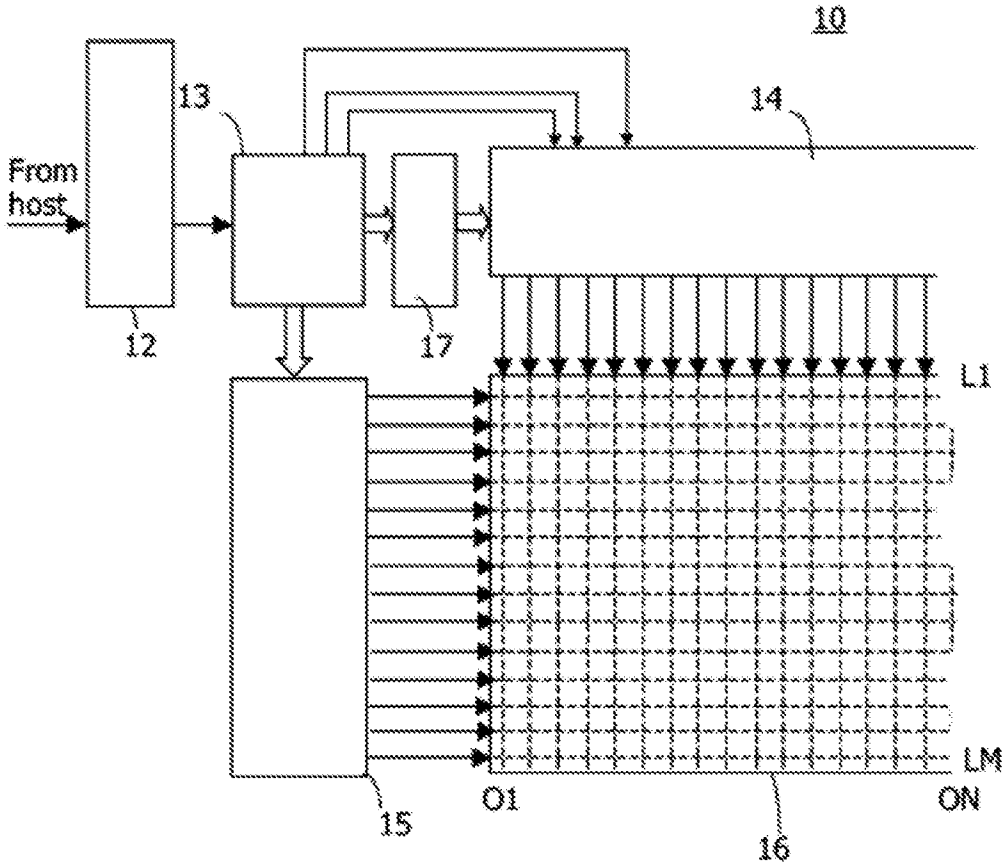
FIG. 8 depicts a block diagram of an example of a conventional display device.

FIG. 8 depicts a block diagram of a conventional display device (e.g., TFT LCD). A plurality of column electrodes of the liquid crystal (LC) panel 16 are driven in parallel by a column driver bank 14 and a plurality of common row electrodes are driven by a row driver array 15 while being selected sequentially. An interface 12 is used as the interface between a microcontroller (not shown) and the display device 10. The interface function 12 is typically realized at the input side of a display timing controller 13. The column driver bank 14 drives the columns of the LC display and it includes N individual output buffers. The column driver bank 14 includes an array of column drivers. Typically, each column driver of the column driver bank 14 serves N column electrodes of the display panel 16 by providing analog output signals. The row driver array 15 comprises an array of row drivers. Each pixel of the display 16 is a switchable capacitor between a row and a column electrode. The display 16 may be a passive matrix LCD panel, although this is not a limitation of the inventive concept.

As illustrated in FIG. 8, there is a buffer 17 located between the display timing controller 13 and the column driver bank 14. This buffer 17 (e.g., RAM) temporality stores image data after having been compressed in accordance with the inventive concept. Image data, which represent an image to be display on the display panel 16, are given by the timing controller 13 via the buffer 17 to the column driver 14 as serial data.

The output of the buffer 17, after having been decompressed, may be sent to the column drivers inside the column driver bank 14. The data is transferred to the outputs of the column drivers in order to drive the display panel 16.

The inventive concept disclosed herein improves the efficiency of compression, which is done to represent the same image data with fewer bits. The method disclosed herein is hardware-friendly, as no floating point calculations are needed. Furthermore, by avoiding the intermediate conversion of RGBG to RGB as mentioned above, any latency or delay is reduced.

While the embodiments are described in terms of a method or technique, it should be understood that the disclosure may also cover an article of manufacture that includes a non-transitory computer readable medium on which computer-readable instructions for carrying out embodiments of the method are stored. The computer readable medium may include, for example, semiconductor, magnetic, opto-magnetic, optical, or other forms of computer readable medium for storing computer readable code. Further, the disclosure may also cover apparatuses for practicing embodiments of the inventive concept disclosed herein. Such apparatus may include circuits, dedicated and/or programmable, to carry out operations pertaining to embodiments.

Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to the embodiments.

It should be understood that the inventive concept can be practiced with modification and alteration within the spirit and scope of the disclosure. Furthermore, the inventive concept may be applied to the cases where compression is done using codecs not explicitly mentioned herein, such as DSC or VDC-M. The description is not intended to be exhaustive or to limit the inventive concept to the precise form disclosed.

What is claimed is:

1. A method of displaying an RGBG-formatted image data, comprising:

receiving, from a display driver, input image data in $Y_0Y_1CoCg$ format;

decoding the received input image data by applying the inverse-color transform as follows to generate a reconstructed image:

determining a R value using $Y_0$, $Y_1$, Co, and Cg;

determining a $G_0$ value using $Y_0$, $Y_1$, and no more than one of Cg and Co;

determining a B value using $Y_0$, $Y_1$, Co, and Cg; and determining a $G_1$ value using $Y_0$, $Y_1$, and no more than one of Cg and Co; and providing the reconstructed image to a display device.

2. The method of claim 1, wherein the decoding is done as follows:

$$\begin{pmatrix} R \\ G_0 \\ B \\ G_1 \end{pmatrix} = \frac{1}{\alpha} * \begin{pmatrix} \frac{1}{2} & \frac{1}{2} & 1 & -1 \\ \frac{3}{2} & -\frac{1}{2} & 0 & 1 \\ \frac{1}{2} & \frac{1}{2} & -1 & -1 \\ -\frac{1}{2} & \frac{3}{2} & 0 & 1 \end{pmatrix} \begin{pmatrix} Y_0 \\ Y_1 \\ Co \\ Cg \end{pmatrix}$$

wherein α is a scaling factor.

3. A method of displaying an RGBG-formatted image data, comprising:

receiving, from a display driver, input image data in $Y_0Y_1$CbCr format;

decoding the received input image data by applying the inverse-color transform as follows to generate a reconstructed image:

$$\begin{pmatrix} R \\ G_0 \\ B \\ G_1 \end{pmatrix} = \frac{1}{\alpha} * \begin{pmatrix} \frac{1}{2} & \frac{1}{2} & -\frac{1}{4} & \frac{3}{4} \\ \frac{3}{2} & -\frac{1}{2} & -\frac{1}{4} & -\frac{1}{4} \\ \frac{1}{2} & \frac{1}{2} & \frac{3}{4} & -\frac{1}{4} \\ -\frac{1}{2} & \frac{3}{2} & -\frac{1}{4} & -\frac{1}{4} \end{pmatrix} \begin{pmatrix} Y_0 \\ Y_1 \\ Cb \\ Cr \end{pmatrix}$$

wherein α is a scaling factor; and providing the reconstructed image to a display device.

4. A method for color transform of an RGBG format image data, comprising:

receiving the RGBG-format image data at a display driver, the RGBG-format image data including a red value (R), a blue value (B), a first green value ($G_0$), and a second green value ($G_1$);

generating a double-luma format image data by:

determining a first luma value based on R, B, and half of one of $G_0$ or $G_1$;

determining a second luma value based on R, B, and half of the other one of $G_0$ or $G_1$;

determining a first chroma value; and determining a second chroma value; and forwarding the double-luma format image data to be reconstructed and displayed on a device having a RGBG pixel layout.

5. The method of claim 4, wherein the first chroma value is a chroma orange value, further comprising determining the chroma orange value based on R and B but not $G_0$ or $G_1$.

6. The method of claim 4, wherein the second chroma value is a chroma green value, further comprising determining the chroma green value based on R, B, $G_0$, and $G_1$.

7. The method of claim 4, wherein the determining of the first luma value $Y_0$, the second luma value $Y_1$, the first chroma value Co, and the second chroma value Cg are done according to the following:

$$\begin{pmatrix} Y_0 \\ Y_1 \\ Co \\ Cg \end{pmatrix} = \alpha * \begin{pmatrix} \frac{1}{4} & \frac{1}{2} & \frac{1}{4} & 0 \\ \frac{1}{4} & 0 & \frac{1}{4} & \frac{1}{2} \\ \frac{1}{2} & 0 & -\frac{1}{2} & 0 \\ -\frac{1}{4} & \frac{1}{4} & -\frac{1}{4} & \frac{1}{4} \end{pmatrix} \begin{pmatrix} R \\ G_0 \\ B \\ G_1 \end{pmatrix}$$

wherein α is a scaling factor.

8. The method of claim 4, wherein the first luma value, the second luma value, the first chroma value, and the second chroma value are applied to one basic unit.

9. The method of claim 4, further comprising conducting an inverse transform as follows:

$$\begin{pmatrix} R \\ G_0 \\ B \\ G_1 \end{pmatrix} = \frac{1}{\alpha} * \begin{pmatrix} \frac{1}{2} & \frac{1}{2} & 1 & -1 \\ \frac{3}{2} & -\frac{1}{2} & 0 & 1 \\ \frac{1}{2} & \frac{1}{2} & -1 & -1 \\ -\frac{1}{2} & \frac{3}{2} & 0 & 1 \end{pmatrix} \begin{pmatrix} Y_0 \\ Y_1 \\ Co \\ Cg \end{pmatrix}$$

wherein α is a scaling factor.

10. The method of claim 4, wherein the first chroma value is a chroma blue value, further comprising determining the chroma blue value based on $G_0$, B, and $G_1$ but not R.

11. The method of claim 4, wherein the second chroma value is a chroma red value, further comprising determining the chroma red value based on $G_0$, and $G_1$ but not B.

12. The method of claim 4, wherein the determining of the first luma value $Y_0$, the second luma value $Y_1$, the first chroma value Cb, and the second chroma value Cr are done according to the following:

$$\begin{pmatrix} Y_0 \\ Y_1 \\ Cb \\ Cr \end{pmatrix} = \alpha * \begin{pmatrix} \frac{1}{4} & \frac{1}{2} & \frac{1}{4} & 0 \\ \frac{1}{4} & 0 & \frac{1}{4} & \frac{1}{2} \\ 0 & -\frac{1}{2} & 1 & -\frac{1}{2} \\ 1 & -\frac{1}{2} & 0 & -\frac{1}{2} \end{pmatrix} \begin{pmatrix} R \\ G_0 \\ B \\ G_1 \end{pmatrix}$$

wherein α is a constant.

13. The method of claim 4, further comprising achieving an inverse transform as follows:

$$\begin{pmatrix} R \\ G_0 \\ B \\ G_1 \end{pmatrix} = \frac{1}{\alpha} * \begin{pmatrix} \frac{1}{2} & \frac{1}{2} & -\frac{1}{4} & \frac{3}{4} \\ \frac{3}{2} & -\frac{1}{2} & -\frac{1}{4} & -\frac{1}{4} \\ \frac{1}{2} & \frac{1}{2} & \frac{3}{4} & -\frac{1}{4} \\ -\frac{1}{2} & \frac{3}{2} & -\frac{1}{4} & -\frac{1}{4} \end{pmatrix} \begin{pmatrix} Y_0 \\ Y_1 \\ Cb \\ Cr \end{pmatrix}.$$

14. The method of claim 4, wherein:

the first luma value is equal to $R/4+G_0/2+B/4+(G_1*0)$ ; and the second luma value is equal to $R/4+(G_0*0)+B/4+G_1/2$ .

15. A display device comprising:

a memory configured to receive a $Y_0Y_1CoCg$ input image data from a display driver and temporarily store the $Y_0Y_1CoCg$ formatted image data that is subjected to a color transform; and a decoder that converts the $Y_0Y_1CoCg$ formatted image data to a reconstructed $RG_0BG_1$ formatted image data by:

determining an R value using $Y_0$, $Y_1$, Co, and Cg;

determining a $G_0$ value using $Y_0$, $Y_1$, and no more than one of Cg and Co;

determining a B value using $Y_0$, $Y_1$, Co, and Cg; and determining a $G_1$ value using $Y_0$, $Y_1$, and no more than one of Cg and Co; and a display panel displaying the reconstructed $RG_0BG_1$ formatted image data.

16. The display device of claim 15, wherein the decoder converts the $Y_0Y_1CoCg$ formatted image data to $RG_0BG_1$ formatted image data as follows:

$$\begin{pmatrix} R \\ G_0 \\ B \\ G_1 \end{pmatrix} = \frac{1}{\alpha} * \begin{pmatrix} \frac{1}{2} & \frac{1}{2} & 1 & -1 \\ \frac{3}{2} & -\frac{1}{2} & 0 & 1 \\ \frac{1}{2} & \frac{1}{2} & -1 & -1 \\ -\frac{1}{2} & \frac{3}{2} & 0 & 1 \end{pmatrix} \begin{pmatrix} Y_0 \\ Y_1 \\ Co \\ Cg \end{pmatrix}$$

wherein α is a constant.

17. The display device of claim 15, wherein the $Y_0Y_1C_oC_g$ formatted image data is encoded as follows:

$$\begin{pmatrix} Y_0 \\ Y_1 \\ Co \\ Cg \end{pmatrix} = \alpha * \begin{pmatrix} \frac{1}{4} & \frac{1}{2} & \frac{1}{4} & 0 \\ \frac{1}{4} & 0 & \frac{1}{4} & \frac{1}{2} \\ \frac{1}{2} & 0 & -\frac{1}{2} & 0 \\ -\frac{1}{4} & \frac{1}{4} & -\frac{1}{4} & \frac{1}{4} \end{pmatrix} \begin{pmatrix} R \\ G_0 \\ B \\ G_1 \end{pmatrix}.$$

18. A display device comprising:

a memory configured to receive a $Y_0Y_1CbCr$ input image data from a display driver and temporarily store a $Y_0Y_1CbCr$ formatted image data that was subjected to a color transform; and a decoder that converts the $Y_0Y_1CbCr$ formatted image data to $RG_0BG_1$ formatted image data as follows to generate a reconstructed image:

$$\begin{pmatrix} R \\ G_0 \\ B \\ G_1 \end{pmatrix} = \frac{1}{\alpha} * \begin{pmatrix} \frac{1}{2} & \frac{1}{2} & -\frac{1}{4} & \frac{3}{4} \\ \frac{3}{2} & -\frac{1}{2} & -\frac{1}{4} & -\frac{1}{4} \\ \frac{1}{2} & \frac{1}{2} & \frac{3}{4} & -\frac{1}{4} \\ -\frac{1}{2} & \frac{3}{2} & -\frac{1}{4} & -\frac{1}{4} \end{pmatrix} \begin{pmatrix} Y_0 \\ Y_1 \\ Cb \\ Cr \end{pmatrix}$$

wherein α is a constant; and a display panel displaying the reconstructed image.

19. The display device of claim 18, wherein the $Y_0Y_1CbCr$ formatted image data is encoded as follows:

$$\begin{pmatrix} Y_0 \\ Y_1 \\ Cb \\ Cr \end{pmatrix} = \alpha * \begin{pmatrix} \frac{1}{4} & \frac{1}{2} & \frac{1}{4} & 0 \\ \frac{1}{4} & 0 & \frac{1}{4} & \frac{1}{2} \\ 0 & -\frac{1}{2} & 1 & -\frac{1}{2} \\ 1 & -\frac{1}{2} & 0 & -\frac{1}{2} \end{pmatrix} \begin{pmatrix} R \\ G_0 \\ B \\ G_1 \end{pmatrix}.$$

20. A non-transitory computer-readable storage medium comprising instructions that, when executed, receive image data in $Y_0Y_1CoCg$ format from a display driver;

convert the image data in $Y_0Y_1CoCg$ format to image data in $RG_0BG_1$ format as follows to generate a reconstructed image:

$$\begin{pmatrix} R \\ G_0 \\ B \\ G_1 \end{pmatrix} = \frac{1}{\alpha} * \begin{pmatrix} \frac{1}{2} & \frac{1}{2} & 1 & -1 \\ \frac{3}{2} & -\frac{1}{2} & 0 & 1 \\ \frac{1}{2} & \frac{1}{2} & -1 & -1 \\ -\frac{1}{2} & \frac{3}{2} & 0 & 1 \end{pmatrix} \begin{pmatrix} Y_0 \\ Y_1 \\ Co \\ Cg \end{pmatrix}$$

wherein α is a constant; and cause the reconstructed image to be displayed on a display panel.

21. A non-transitory computer-readable storage medium comprising instructions that, when executed, receive image data in $Y_0Y_1CbCr$ format from a display driver;

convert the image data in $Y_0Y_1CbCr$ format to image data in $RG_0BG_1$ format as follows to generate a reconstructed image:

$$\begin{pmatrix} R \\ G_0 \\ B \\ G_1 \end{pmatrix} = \frac{1}{\alpha} * \begin{pmatrix} \frac{1}{2} & \frac{1}{2} & -\frac{1}{4} & \frac{3}{4} \\ \frac{3}{2} & -\frac{1}{2} & -\frac{1}{4} & -\frac{1}{4} \\ \frac{1}{2} & \frac{1}{2} & \frac{3}{4} & -\frac{1}{4} \\ -\frac{1}{2} & \frac{3}{2} & -\frac{1}{4} & -\frac{1}{4} \end{pmatrix} \begin{pmatrix} Y_0 \\ Y_1 \\ Cb \\ Cr \end{pmatrix}$$

wherein $\alpha$ is a constant; and cause the reconstructed image to be displayed on a display panel.

* * * * *